United States Patent [19]

Buxmann

[11] Patent Number: 5,052,470

[45] Date of Patent: Oct. 1, 1991

[54] PROCESS FOR CONTINUOUS PRODUCTION OF AN EXTRUDED SECTION

[75] Inventor: Kurt Buxmann, Sierre, Switzerland

[73] Assignee: Swiss Aluminum Ltd., Chippis, Switzerland

[21] Appl. No.: 421,658

[22] Filed: Oct. 16, 1989

[30] Foreign Application Priority Data

Oct. 31, 1988 [CH] Switzerland ..... 4050/88

[51] Int. Cl.[5] ..... B22D 11/00

[52] U.S. Cl. ..... 164/467; 164/476; 72/262

[58] Field of Search ..... 164/466, 467, 476, 503; 72/262

[56] References Cited

U.S. PATENT DOCUMENTS 4,718,476 1/1988 Eibe ..... 164/476
4,763,502 8/1988 Backus .

FOREIGN PATENT DOCUMENTS 0244254 4/1987 European Pat. Off. .
2818927 11/1978 Fed. Rep. of Germany ..... 72/262
148651 8/1985 Japan ..... 164/476
192242 8/1987 Japan ..... 164/476
1499809 2/1978 United Kingdom .
1516306 7/1978 United Kingdom .

OTHER PUBLICATIONS

Japanese Patent Abstract No. 90, vol. 8; Jap. Appln. No. 57-116014, Filed Jul. 2, 1982.
Japanese Patent Abstract No. 207, vol. 7; Jap. Appln. No. 56-203162; Filed Dec. 15, 1981.
Japanese Patent Abstract No. 6, vol. 5; Jap. Appln. No. 54-46192, Filed Apr. 16, 1989.

*Primary Examiner*—Richard K. Seidel
*Assistant Examiner*—Edward A. Brown
*Attorney, Agent, or Firm*—Bachman & LaPointe

[57] ABSTRACT

A process for continuous production of an extruded section, in particular of aluminum or an aluminum alloy, wherein a prefabricated rod is fed to a die by means of a friction wheel and extruded through the die. The rod is formed by casting the molten metal in an electromagnetic mold and the solidified rod fed directly to the friction wheel the circumference of which advances the rod at the same speed as the rate of casting of the rod in the electromagnetic mold. The process enables high quality extruded sections to be produced at a economic cost.

5 Claims, 1 Drawing Sheet

PROCESS FOR CONTINUOUS PRODUCTION OF AN EXTRUDED SECTION

BACKGROUND OF THE INVENTION

The present invention relates to a process for the continuous production of an extruded section, in particular a section made of aluminum or an aluminum alloy, in which a previously fabricated rod is introduced to and pressed through a die by means of a friction wheel.

A process for the continuous production of extruded sections is known under the name CONFORM. In that process, metal in the form of granules, pre-extruded bar or cast rod (Properzi rod) serving as starting materials is introduced into the groove of a friction wheel then pressed through a die. The above-mentioned starting materials, however, exhibit certain disadvantages.

Pre-extruded bar material normally ensures a good quality product. The costs, however, are high as a preliminary extrusion step must be performed prior to the conform process. Furthermore, such rod is normally not coiled so that it is difficult to introduce the rod into the groove of the friction wheel.

Properzi rod can usually be produced free of defects only with pure aluminum and dilute aluminum alloys. Further, such rod normally features structural defects such as, for example, central porosity or non-uniform cell structure.

The use of conventionally cast rods of higher alloyed materials leads to problems of quality as these rods normally feature an approximately 1 cm thick segregation zone at the surface which builds up in the friction wheel and leads to segregate entering the extrusion.

In the case of another known continuous process liquid metal is poured into the groove of a cooled friction wheel and the solidified metal is subsequently extruded through a die. In this so called CASTEX casting process, the solidification takes place in the groove of the cooled friction wheel. The solidification conditions are comparable with those noted above with regard to Properzi rod and, consequently similar problems relating to casting and structural inhomogenity are experienced. Furthermore, the peripheral shell solidifying in contact with the groove is subjected to mechanical deformation as a result of the braking action of the backer block. This leads to further structural inhomogenities, for example, segregation effects which appear in the product which are a detriment to product quality. In general, the process is not sufficiently developed for commerical application to higher alloyed materials.

Accordingly, it is principle, the object of the present invention to produce extruded sections using a friction wheel wherein the sections are of high quality and economic to produce. In order to accomplish the foregoing an appropriately shaped intermediate product is produced as the starting material for extrusion and introduced in the solidified state into the friction wheel.

SUMMARY OF THE INVENTION

The foregoing object is achieved by way of the process of the present invention which comprises casting molten metal in an electromagnetic mold so as to produce a solidified cast rod and thereafter feeding the solidified cast rod to the friction wheel which advances the solidified rod under extrusion force to a drawing die through which the rod is extruded.

The process according to the present invention enables an extruded product of very high quality to be produced at very low cost. As a result of solidifying in the electromagnetic mold the starting material has a very fine as-cast structure, so that the intermetallic phases in the matrix are finer than the corresponding phases in an extruded rod.

Furthermore, the deformed structure of the extruded product produced by the process according to the present invention is uniform, whereas, in the prior art extruded rods having different degrees of deformation occur depending on whether the product originates from the start or finish of extrusion. Similar differences arise also when using pre-extruded rod as starting material.

A further advantage of the process according to the present invention is that the whole range of conventional aluminum alloys can be manufactured. There are no limitations on the castability of small format rod in an electromagnetic field.

BRIEF DESCRIPTION OF THE DRAWINGS

Further advantages, features and details of the present invention are revealed in the following description of a preferred exemplified embodiment and with the aid of the single schematic drawing showing, in cross-section, a device for carrying out the process according to the present invention.

DETAILED DESCRIPTION

Figure 1:
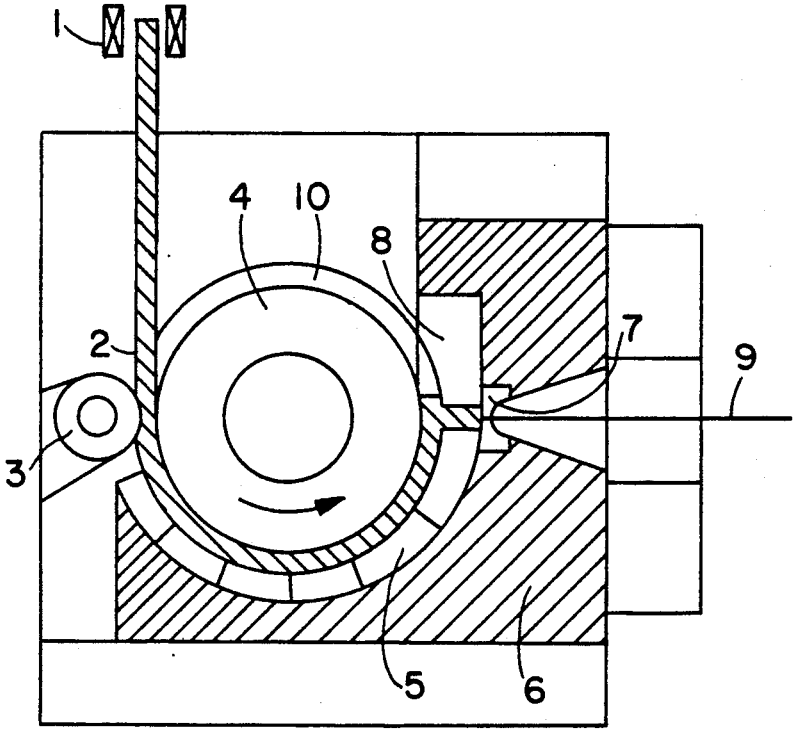

A rod 2 is cast using an electromagnetic mold 1 thereafter with the aid of a compression wheel 3, is immediately introduced into the groove 10 of a friction wheel 4. The groove 10 of the friction wheel 4 is closed over by cover segments 5 via a backer block 6. The compressive force required to form extruded section 9 is built up via a counter-segment 8 formed in the region of a die 7.

The speed at which the friction wheel 4 advances the rod 2 is the same as the speed of casting of rod 2 in the electromagnetic mold 1. The friction wheel 4 provides the force to advance the rod 2 for solidifying in the electromagnetic mold 1.

The rod 2 is maintained at a temperature of about 250° C. and preferably of about 350° C. by means of a computer controlled cooling process (not shown) in order to reduce the work of deformation in the friction wheel 4.

By using a die situated in line with the friction wheel 4, section 9 emerging from the friction wheel can be drawn down to the required thickness tolerance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the continuous production of metal extruded sections comprising providing a molten metal melt, casting said molten metal in an electromagnetic mold so as to produce a solidified cast rod, and feeding said solidified rod to a friction wheel directly after casting in said electromagnetic mold wherein said friction wheel advances said rod under extrusion force to a die through which said rod is extruded.

2. A process according to claim 1 wherein the rate of movement of the rod by the friction wheel is substantially equal to the casting rate of the rod in the electromagnetic mold.

3. A process according to claim 1 wherein the temperature of the rod on entering the friction wheel is maintained above 250° C.

4. A process according to claim 1 wherein the friction wheel provides the force for advancing the rod solidifying in the electromagnetic mold.

5. A process according to claim 5 wherein the extruded section emerging from the friction wheel is drawn down to the required thickness tolerance by means of said die situated in line with the friction wheel.

* * * * *